US009663847B2

(12) United States Patent
Kim et al.

(10) Patent No.: US 9,663,847 B2
(45) Date of Patent: May 30, 2017

(54) HIGH THERMAL CONDUCTIVITY AL—MG—FE—SI ALLOY FOR DIE CASTING

(71) Applicant: KOREA INSTITUTE OF INDUSTRIAL TECHNOLOGY, Cheonan-si, Chungcheongnam-do (KR)

(72) Inventors: Ki Tae Kim, Seoul (KR); Je Sik Shin, Bucheon-si (KR); Se Hyun Ko, Yongin-si (KR)

(73) Assignee: KOREA INSTITUTE OF INDUSTRIAL TECHNOLOGY, Cheonan-si, Chungcheongnam-Do (KR)

( * ) Notice: Subject to any disclaimer, the term of this patent is extended or adjusted under 35 U.S.C. 154(b) by 368 days.

(21) Appl. No.: 14/350,079

(22) PCT Filed: Oct. 9, 2012

(86) PCT No.: PCT/KR2012/008161
§ 371 (c)(1),
(2) Date: Apr. 7, 2014

(87) PCT Pub. No.: WO2013/055074
PCT Pub. Date: Apr. 18, 2013

(65) Prior Publication Data

US 2014/0234161 A1 Aug. 21, 2014

(30) Foreign Application Priority Data

Oct. 10, 2011 (KR) ..... 10-2011-0103116

(51) Int. Cl.
*C22C 21/08* (2006.01)
*C22F 1/047* (2006.01)
*C22C 21/00* (2006.01)

(52) U.S. Cl.
CPC ..... *C22C 21/08* (2013.01); *C22C 21/00* (2013.01)

(58) Field of Classification Search
CPC ..... C22C 21/08; C22F 1/047; C22F 1/05
USPC ..... 420/546, 548, 550
See application file for complete search history.

(56) References Cited

U.S. PATENT DOCUMENTS

| | | | | | |
|---|---|---|---|---|---|
| 4,169,728 | A * | 10/1979 | Takeuchi | C22C 21/08 | 420/532 |
| 7,189,294 | B2 | 3/2007 | Kimura et al. | | |
| 2002/0014287 | A1* | 2/2002 | Yoshihara | C22C 21/08 | 420/546 |
| 2002/0088512 | A1* | 7/2002 | Kitaoka | C22C 21/08 | 420/544 |
| 2004/0035505 | A1* | 2/2004 | Unal | C22F 1/047 | 420/546 |
| 2004/0213695 | A1* | 10/2004 | Ferreira | C22C 21/08 | 420/546 |
| 2014/0234159 | A1* | 8/2014 | Kim | C22C 21/00 | 420/540 |
| 2015/0218678 | A1* | 8/2015 | Kim | C22C 21/10 | 420/541 |

FOREIGN PATENT DOCUMENTS

| | | | |
|---|---|---|---|
| JP | 53/056114 | A * | 5/1978 |
| JP | 56/166359 | A * | 12/1981 |
| JP | 56-166359 | A | 12/1981 |
| JP | 05-171324 | A | 7/1993 |
| JP | 2002/348626 | A * | 12/2002 |
| JP | 2002-348626 | A | 12/2002 |
| JP | 2009-102737 | A | 5/2009 |

OTHER PUBLICATIONS

English translation of the Written Opinion of the International Search Report mailed Mar. 14, 2013 for PCT/KR2012/008161; 5 pages.*
English translation of JP 58/053702B; Nov. 1983; 4 pages.*
English translation of JP 56/166359A; Nov. 1981; 4 pages.*
English translation of JP 58/030381 B; Jun. 1983; 6 pages.*
English translation of JP 2002/348626A; Dec. 2002; 5 pages.*

* cited by examiner

*Primary Examiner* — Helene Klemanski
(74) *Attorney, Agent, or Firm* — Revolution IP, PLLC

(57) ABSTRACT

Disclosed is an aluminum alloy for die casting which comprises 1.0 weight % to 2.0 weight % of magnesium (Mg), 0.5 weight % to 1.6 weight % of iron (Fe), and 0.5 weight % to 0.9 weight % of silicon (Si), with the remainder being aluminum (Al) and inevitable impurities.

3 Claims, 1 Drawing Sheet

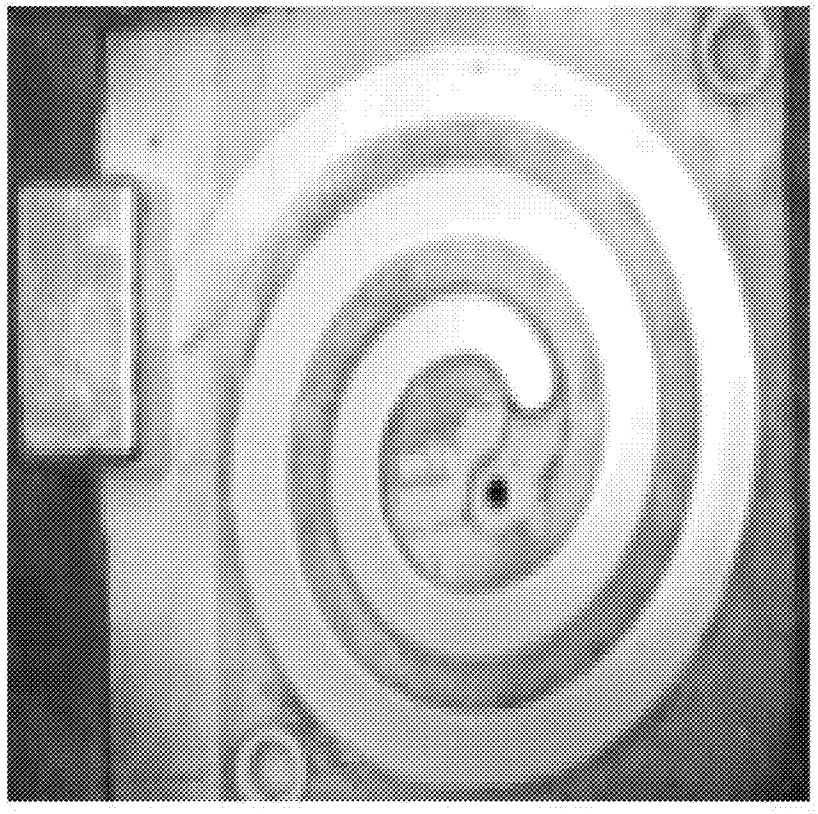

HIGH THERMAL CONDUCTIVITY AL—MG—FE—SI ALLOY FOR DIE CASTING

CROSS REFERENCE TO PRIOR APPLICATIONS

This application is a National Stage Application of PCT International Patent Application No. PCT/KR2012/008161 filed on Oct. 9, 2012, under 35 U.S.C. §371, which claims priority to Korean Patent Application No. 10-2011-0103116 filed on Oct. 10, 2011, which are all hereby incorporated by reference in their entirety.

TECHNICAL FIELD

The present invention relates to a high thermal conductivity aluminum alloy for die casting, and more particularly, to an aluminum alloy having excellent thermal conductivity as well as excellent castability.

BACKGROUND ART

Die-casting is also referred to as a metal casting process. The die-casting is a precision casting method in which molten metal is injected into a steel mold cavity which is precisely machined so as to be completely matched with a required casting shape, thereby obtaining a casting having the same shape as the mold cavity.

Since the die castings have accurate dimensions, they have advantages, such as excellent mechanical properties, possibility of mass production as well as little or no finishing operations. Meanwhile, metals used in die casting are generally alloys of zinc, aluminum, tin, copper, magnesium, and the like, and after melted to molten metals, these alloys are injected into a mold cavity by a pressing apparatus, such as an air pressure device, a hydraulic pressure device and an oil pressure device, etc., to be quenched and then solidified.

The die castings manufactured through these processes are used in a variety of fields, and specially, employed in vehicle components, and also widely used in manufacturing of components, such as components of electronic instruments, optical instruments, vehicles, weaving machines, construction equipments and measuring instruments.

Meanwhile, Al—Si based alloys and Al—Mg based alloys with excellent castability are mainly used as aluminum alloys for die casting. Since Al—Si based alloys or Al—Mg based alloys have excellent castability, but a low thermal conductivity of 90-140 W/mK, the use thereof in heat dissipation components for electric devices, electronic devices, and vehicles requiring a high thermal conductivity of 160 W/mK or more is limited.

In heat dissipation devices requiring such a high thermal conductivity, while products cast with pure aluminum having a very high thermal conductivity of 220 W/mK or higher are partly used in rotors for electrical and electronic products, since pure aluminum has an excellent thermal conductivity, but a low tensile strength and low castability, its application in structural components requiring excellent mechanical properties as well as the excellent thermal conductivity is limited.

Therefore, for use in heat dissipation components for electric devices, electronic devices and vehicles, the development of aluminum alloys for die casting having a high thermal conductivity of 160 W/mK or more as well as excellent castability is acutely needed, but aluminum alloys having a thermal conductivity of 160 W/mK or more as well as excellent castability have not yet been developed. Therefore, Al—Si based alloys, Al—Mg based alloys, and the like with the thermal conductivity of 90-140 W/mK are currently used as aluminum alloys for die casting.

DISCLOSURE OF THE INVENTION

Technical Problem

The present invention is devised to solve the above-described problems of existing arts, and an object of the invention is to provide an aluminum alloy for die casting including magnesium (Mg) and iron (Fe) as main alloying elements and having a thermal conductivity of 160 W/mK or more together with good castability and mechanical properties.

Technical Solution

In order to accomplish the above-described objects, the present invention provides an aluminum alloy for die casting including 1.0 weight % to 2.0 weight % of magnesium (Mg), 0.8 to 1.6 weight % of iron (Fe), 0.5 weight % to 0.9 weight % of silicon (Si), with the remainder being aluminum (Al) and inevitable impurities.

Also, in the aluminum alloy according to the present invention, a thermal conductivity may be 160 W/mK or more, and preferably 170 W/mK or more.

Also, in the aluminum alloy according to the present invention, a difference ($\Delta T$) between the solidus temperature and the liquidus temperature in a two-phase Mushy zone may be 70° C. or less.

Also, in the aluminum alloy according to the present invention, a tensile strength is 140 MPa or more.

Also, in the aluminum alloy according to the present invention, the aluminum alloy may include Fe compounds dispersed in a microstructure thereof.

Advantageous Effects

An aluminum alloy according to the present invention may secure castability required for obtaining healthy castings in a die casting process while including magnesium (Mg) and iron (Fe) as primary alloy elements, and also have very excellent thermal conductivity of 160 W/mK or more and a tensile strength of 130 MPa or more through controlling the content of silicon (Si), so that the aluminum alloy may be suitably used in manufacturing of heat dissipation components for electrical devices, electronic devices and vehicles requiring a high thermal conductivity and a considerable level of mechanical strength.

BRIEF DESCRIPTION OF THE DRAWINGS

FIG. 1 is a photograph of a flow length measurement device for evaluating castability of an aluminum alloy according to the present invention.

MODE FOR CARRYING OUT THE INVENTION

Hereinafter, an aluminum alloy according to preferred embodiments of the present invention will be described in detail but the present invention is not limited to the following embodiments. Therefore, it will be apparent to those skilled in the art that many modifications and variations may be made without departing from the spirit thereof.

Also, the terms of a single form used for explaining exemplary embodiments may include plural forms unless otherwise specified.

An aluminum alloy according to the present invention is a high thermal conductivity aluminum alloy for die casting obtained by alloying magnesium (Mg), iron (Fe) and silicone (Si), and includes 1.0 weight % to 2.0 weight % of magnesium (Mg), 0.5 weight % to 1.6 weight % of iron (Fe), and 0.5 weight % to 0.9 weight % of silicon (Si), with the remainder being aluminum (Al) and inevitable impurities.

By complexly adding alloy elements capable of improving the castability of aluminum on depending the respective compositions, alloy elements solid-solutioned in an aluminum matrix metal to be capable of obtaining effects of solid solution strengthening, and alloy elements capable of minimizing the degradation of thermal conductivity due to the very low solid solubility in the aluminum matrix metal, the aluminum alloy for die casting according to the present invention may represent good thermal conductivity of 160 W/mK or more as well as excellent castability and good mechanical properties.

The reason why the respective alloy elements are added and limited in content is as follows.

Magnesium (Mg) is an element which may be added in aluminum as an alloy element to improve castability and improve a tensile strength according to the effects of solid solution strengthening. 1.0 weight % to 2.0 weight % of magnesium is added in the aluminum alloy for die casting according to the present invention because if the content of magnesium is less than 1.0 weight %, the castability is lowered, so that a casting defect in which aluminum alloy products are not partially molded occurs easily when products are molded by die casting, and if the content of magnesium exceeds 0.2 weight %, a thermal conductivity is lowered, so that the thermal conductivity of 160 W/mK or more may not be obtained.

Since iron (Fe) has a very low solubility of 0.052 weight % in aluminum at room temperature, and after casting, is mostly crystallized as intermetallic compounds, such as $Al_3Fe$, and the like, iron is an element which may be added in aluminum to minimize the degradation of thermal conductivity of aluminum, improve the strength of aluminum, and reduce die soldering when aluminum alloy products are molded by die casting. 0.5 weight % to 1.6 weight % of iron may be added in the aluminum alloy for die casting according to the present invention. This is because if the content of iron is less than 0.5 weight %, the effects of preventing die soldering is lowered, so that soldering phenomena of products occur on a part of the mold cavity and a mechanical strength is not sufficient, and if the content of iron exceeds 1.6 weight %, a Fe-rich phase is excessively crystallized to reduce the castability of the alloy. More preferable content of iron is from 1.0 to 1.2 weight %.

Silicon (Si) is an element which may be added in aluminum as an alloy element to improve the castability and improve a tensile strength according to the effects of solid solution strengthening. 0.5 weight % to 0.9 weight % of silicon may be added in the aluminum alloy for die casting according to the present invention. This is because if the content of silicon is less than 0.5 weight %, the castability is lowered, so that a non-molded part partly occurs to considerably damage healthiness of products when products are molded by die casting, and if the content of silicon exceeds 0.9 weight %, a thermal conductivity is lowered, so that a thermal conductivity of 160 W/mK or more targeted by the present invention may not be obtained. More preferable content of silicon is from 0.5 weight % to 0.6 weight %.

Inevitable impurities means impurities unintentionally mixed by raw materials or manufacturing devices in a process of manufacturing the alloy according to the present invention, each component of these impurities is maintained in an amount not more than 0.1 weight %, preferably not more than 0.01 weight %, and more preferably not more than 0.01 weight %.

EXAMPLES

A high thermal conductivity Al—Mg—Fe—Si alloy for die casting according to exemplary embodiments of the present invention will be described in detail with reference to Tables 1 and 2 below.

The inventors of the present invention manufactured specimens of alloys having compositions shown in Table 1 below in order to manufacture a high conductivity Al—Mg—Fe—Si alloy for die casting by using a melt stirring method which is typically used in die casting.

TABLE 1

| Alloy (weight %) | | Composition (weight %) | | | |
|---|---|---|---|---|---|
| | | Mg | Fe | Si | Al |
| Example | 1 | 1.07 | 1.15 | 0.54 | bal. |
| | 2 | 1.65 | 1.14 | 0.56 | bal. |
| | 3 | 1.13 | 0.56 | 0.79 | bal. |
| | 4 | 1.27 | 0.56 | 0.79 | bal. |
| Comparative example | 1 | 0.21 | 1.17 | 10.20 | bal. |
| | 2 | 0.53 | 1.11 | 0.55 | bal. |
| | 3 | 2.5 | 1.30 | 0.50 | bal. |
| | 4 | 1.4 | 0.50 | 1.4 | bal. |
| | 5 | 1.4 | 0.7 | 0.4 | bal. |
| | 6 | 1.5 | 2.0 | 0.8 | bal. |

In detail, raw materials of aluminum alloy were prepared so as to have compositions shown in Table 1, the raw materials were charged into an electric resistance melting furnace and melted to form molten metals in atmosphere, and then flow test specimens for evaluating castability were manufactured by using a flow length measurement device as shown in FIG. 1 and also specimens for evaluating properties used for measurement of a thermal conductivity, the liquidus temperature, the solidus temperature, and the like were manufactured.

With respect to the thermal conductivity that is one among main objects of the alloy according to the present invention, firstly, the electrical conductivity of manufactured specimens was measured by using a electrical conductivity meter at room temperature, and then the thermal conductivity was obtained by the conversion formula of [formula 1].

$$K=5.02\sigma T\times10^{-9}+0.03 \quad \text{[Formula 1]}$$

(where K is a thermal conductivity, σ is a electrical conductivity, and T is an absolute temperature)

Also, in order to evaluate the castability that is essential in die cast casting, the molten alloy was injected into a mold cavity maintained at a temperature of 200° C. and having a width of 12 mm, a thickness of 5 mm and a maximum length of 780 mm as shown in FIG. 1, and a flow length was measured through a method of measuring a solidified length, and also the size (ΔT) of a two-phase Mushy zone was measured through a method of measuring a difference between the liquidus temperature and the solidus temperature by using a thermal analyzer.

Table 2 shows results in which the flow length, the thermal conductivity, the liquidus temperature, the solidus temperature, and the difference between the liquidus temperature and the solidus temperature were evaluated.

TABLE 2

| Alloy | | flow length (mm) | Thermal conductivity (W/mK) | Liquidus temperature (° C.) | Solidus temperature (° C.) | ΔT (° C.) |
|---|---|---|---|---|---|---|
| Example | 1 | 780 | 175 | 652 | 618 | 34 |
| | 2 | 780 | 167 | 654 | 588 | 66 |
| | 3 | 780 | 182 | 656 | 601 | 55 |
| | 4 | 780 | 182 | 653 | 598 | 55 |
| Comparative example | 1 | 780 | 95 | 582 | 557 | 74 |
| | 2 | 558 | 179 | 655 | 631 | 24 |
| | 3 | — | 146 | 630 | 585 | 45 |
| | 4 | — | 147 | 645 | 563 | 82 |
| | 5 | 720 | 191 | 652 | 627 | 25 |
| | 6 | 520 | — | — | — | — |

As identified in Table 2 above, all of aluminum alloys according to Examples 1 to 4 of the present invention have a thermal conductivity of 165 W/mK or more (furthermore, 175 W/mK or more), which is a level or more required in various heat dissipation compartments.

Also, the flow length and the difference (ΔT) between the liquidus temperature and the solidus temperature shown in Table 2 are primary indices capable of evaluating the castability of alloys, in which as the more the flow length, the more the fluidity of the alloy is excellent and the less the difference ΔT, the more the castability is excellent.

As identified in Table 2 above, all of aluminum alloys according to Examples of the present invention have the flow length of 780 mm, which is a level comparable to that of an Al—Si alloy (ADC 12, Comparative example 1) widely used as an aluminum alloy for die casting.

Furthermore, the difference (ΔT) between the liquidus temperature and the solidus temperature in the aluminum alloys according to Examples 1 to 4 of the present invention is not more than 70° C., and is lower than that of Comparative example 1 that is an Al—Si alloy (ADC 12) widely used as an aluminum alloy for die casting. In other words, the die-casting castability of the alloys according to Examples 1 to 4 of the present invention is equal to or more excellent than that of a typical Al—Si alloy (ADC 12) widely used as an aluminum alloy for die casting.

Meanwhile, Comparative example 2 has a magnesium content of 0.53 weight %, which is lower than those of Examples of the present invention, and as a result, the flow length is 555 mm, which is remarkably lower than those of the alloys according to Examples of the present invention, and thus the castability is lower than those of Examples of the present invention.

Furthermore, Comparative example 3 has a magnesium content of 2.5 weight %, which is higher than those of Examples of the present invention, and as a result, the thermal conductivity is 146 W/mK, which is lower than those of Examples of the present invention.

Furthermore, Comparative example 4 has a silicon content of 1.4 weight %, which is higher than those of Examples of the present invention, and as a result, the thermal conductivity is 147 W/mK, which is lower than those of Examples of the present invention.

Furthermore, Comparative example 5 has a silicon content of 0.4 weight %, which is lower than Examples of the present invention, and as a result, the flow length is 720 mm, which is remarkably lower than those of Examples of the present invention.

Furthermore, Comparative example 6 has an iron content of 2.0 weight %, which is higher than those of Examples of the present invention, and as a result, the flow length is 520 mm, which is lower than those of Examples of the present invention.

Table 3 shows tensile test results in which the test was conducted with tensile test specimens manufactured from the respective alloys according to Examples of the present invention and the alloy according to Comparative example 1.

TABLE 3

| Alloy (weight %) | | Mg | Fe | Si | Al | Tensile Strength (MPa) | Yield Strength (MPa) | Elongation (%) |
|---|---|---|---|---|---|---|---|---|
| Example | 1 | 1.07 | 1.15 | 0.54 | bal. | 143 | 136 | 10 |
| | 2 | 1.65 | 1.14 | 0.56 | bal. | 153 | 132 | 8 |
| | 3 | 1.13 | 0.56 | 0.79 | bal. | 130 | 108 | 18 |
| | 4 | 1.27 | 0.56 | 0.79 | bal. | 138 | 103 | 18 |
| Comparative example 1 | | 0.21 | 1.17 | 10.20 | bal. | 134 | 120 | 3 |

As identified in Table 3, the alloys according to Examples 1, 2 and 4 of the present invention show tensile strengths (from 138 to 153 MPa), which are higher than that of an Al—Si alloy (ADC 12, Comparative example 1) widely used as an aluminum alloy for die casting, and also have an excellent elongation. Further, compared with Comparative example 1, the alloy according to Example 3 of the present invention has a similar tensile strength to and a more excellent elongation than Comparative example 1.

That is, the aluminum alloys according to Examples of the present invention have more excellent mechanical properties and thermal conductivity properties than an Al—Si alloy (ADC 12, Comparative example 1) widely used as an aluminum alloy for die casting, and also have castability equal to an Al—Si alloy (ADC 12, Comparative example 1) widely used as an aluminum alloy for die casting, so that the aluminum alloys according to Examples of the present invention may be suitably used as aluminum materials for die casting for heat dissipation compartments.

The invention claimed is:

1. An aluminum alloy for die casting, consisting essentially of:

1.0 weight % to 2.0 weight % of magnesium (Mg);

1.0 weight % to 1.2 weight % of iron (Fe); and 0.5 weight % to 0.56 weight % of silicon (Si), wherein the remainder are aluminum (Al) and inevitable impurities, wherein the aluminum alloy has a thermal conductivity of 160 W/mK or more.

2. The aluminum alloy of claim 1, wherein a difference (ΔT) between the solidus temperature and the liquidus temperature of the aluminum alloy is not more than 70° C.

3. The aluminum alloy of claim 1, wherein the aluminum alloy has a tensile strength of 140 MPa or more.

* * * * *